United States Patent [19]

Chanson et al.

[11] 4,282,588

[45] Aug. 4, 1981

[54] RESONANT ACOUSTIC TRANSDUCER AND DRIVER SYSTEM FOR A WELL DRILLING STRING COMMUNICATION SYSTEM

[75] Inventors: Gary J. Chanson, Weston; Alexander M. Nicolson, Concord, both of Mass.

[73] Assignee: Sperry Corporation, New York, N.Y.

[21] Appl. No.: 114,040

[22] Filed: Jan. 21, 1980

[51] Int. Cl.[3] ..... G01V 1/40

[52] U.S. Cl. ..... 367/82; 367/165; 367/180; 310/322; 310/334; 310/355

[58] Field of Search ..... 367/82, 155, 165, 180; 310/322, 323, 334, 355

[56] References Cited

U.S. PATENT DOCUMENTS 2,858,108 10/1958 Wise et al. ..... 367/82

3,900,827 8/1975 Lamel et al. ..... 367/82

*Primary Examiner*—Howard A. Birmiel

*Attorney, Agent, or Firm*—Howard P. Terry

[57] ABSTRACT

The acoustic data communication system includes an acoustic transmitter and receiver wherein low frequency acoustic waves, propagating in relatively loss free manner in well drilling string piping, are efficiently coupled to the drill string and propagate at levels competitive with the levels of noise generated by drilling machinery also present in the drill string. The transmitting transducer incorporates a mass-spring piezoelectric transmitter and amplifier combination that permits self-oscillating resonant operation in the desired low frequency range.

8 Claims, 8 Drawing Figures

RESONANT ACOUSTIC TRANSDUCER AND DRIVER SYSTEM FOR A WELL DRILLING STRING COMMUNICATION SYSTEM

The invention described herein was made in the course of or under a contract or subcontract with the U.S. Energy Research and Development Agency.

CROSS REFERENCE TO RELATED APPLICATION

The present application is related to the copending U.S. patent application Ser. No. 114,038, filed concurrently herewith on Jan. 21, 1980, in the name of A. P. Nardi, entitled "Improved Acoustic Transducer System for a Well Drilling String," and assigned to Sperry Corporation.

BACKGROUND OF THE INVENTION

1. Field of the Invention

The invention relates generally to the art of transmitting information in the form of acoustic waves propagating along a well drilling string or other similar pipe. More particularly, the invention concerns novel piezoelectric transducer acoustic wave generator apparatus for operation in the relatively low-loss acoustic-frequency propagation range of a well drilling string or similar piping.

2. Description of the Prior Art

There are many illustrations in the prior art of data transmission systems for telemetering data in either direction along well drilling strings, some employing electrical and others acoustic propagation. The acoustic systems generally operate in relatively high frequency ranges spaced apart from the large volume of low frequency energy normally developed by the operating elements of the drilling process. Most of the drilling noise is concentrated in that relatively low frequency range which is also desirable for acoustic telemetering because of its relatively low loss characteristics. It is the intent of the present invention to supply transducer means for efficiently coupling acoustic energy into the drill string at relatively high levels competitive with the level of the drilling noise.

SUMMARY OF THE INVENTION

The present invention provides an acoustic communication system including an acoustic transmitter and receiver, wherein lower frequency acoustic waves, propagating in relatively loss free manner in well drilling string piping, are efficiently coupled to the drill string and propagate energy at levels competitive with the levels of drilling machinery generated noise energy also present in the drill string. The transmitting transducer incorporates a mass-spring-piezoelectric transmitter combination that permits self-resonant operation in the desired lower frequency range.

DESCRIPTION OF THE PREFERRED EMBODIMENTS

Figures 1, 1A:
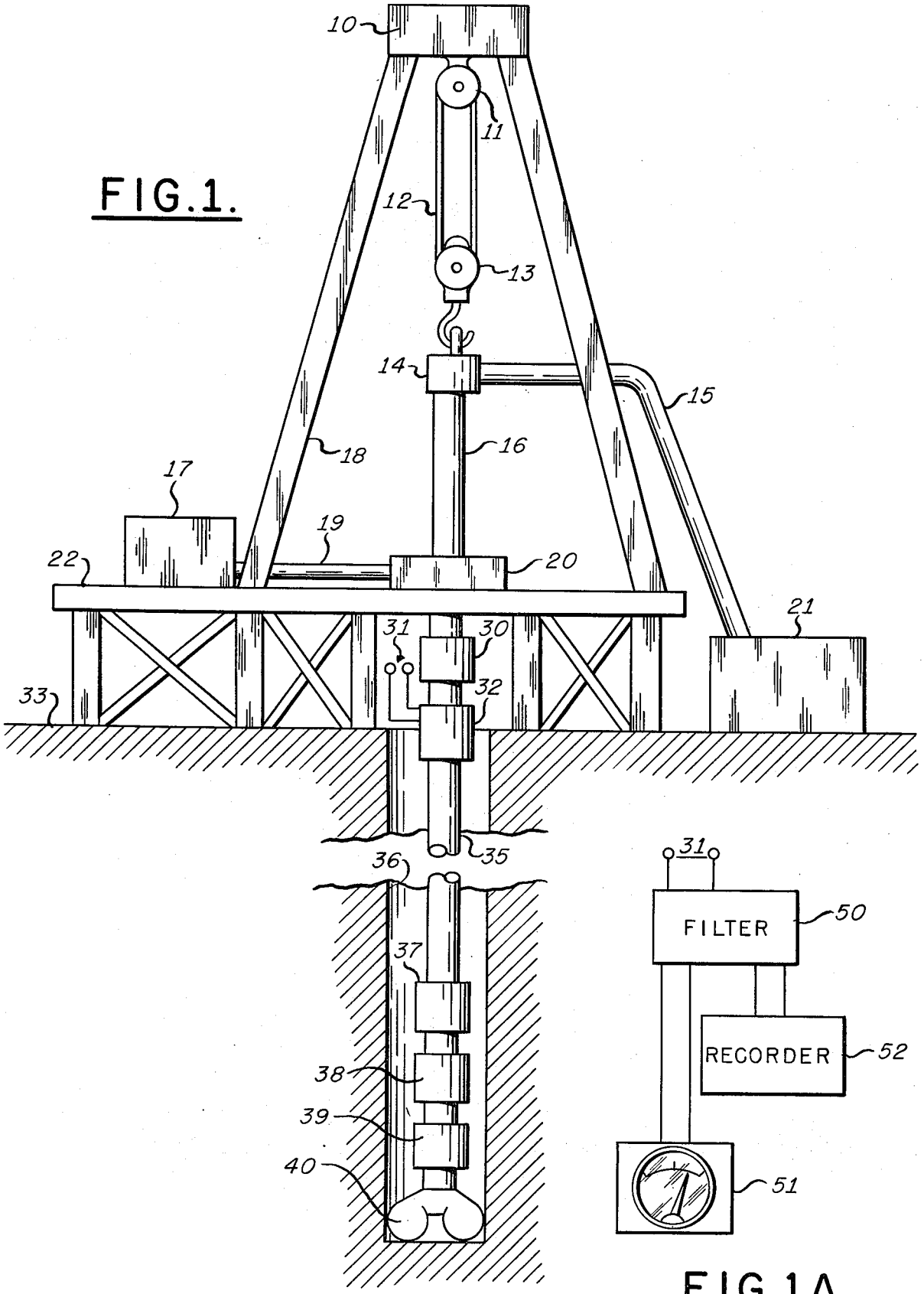
FIG. 1 illustrates, in partial cross section, drilling apparatus employing an acoustic transmitter according to the present invention.
FIG. 1A is a diagram of surface and other equipment useful with the apparatus of FIG. 1.

FIG. 1 illustrates the principal elements of the telemeter or communication system and of the well drilling apparatus employed for drilling a well bore 36 below the surface 33 of the earth. Use is made of the drill string 35 and the drill bit 40 for drilling the bore 36 and the drill string 35 is also adapted simultaneously to be used as an acoustic propagation medium for telemetering data relative to the progress or state of the drilling operation upward to instruments located above the earth's surface 33, for example.

The drilling apparatus of FIG. 1 includes a derrick 18 from which is supported the drill string 35 terminated by the drill bit 40. Drill string 35 is suspended from a movable block 13 from a top platform 10 of derrick 18 and its vertical position may be changed by operation of the usual cable loop 12 by winch 11 at platform 10. The entire drill string 35 may be continuously rotated by the rotation of rotary table 20 and the square or polygonal kelly 16 slidably passing through a square or polygonal aperture in rotary table 20. Motor 17, located on the surface or drilling platform 22 near rotary table 20, and shaft 19 are used to drive table 20 and therefore to rotate drill string 35. This conventional apparatus may be completed in essential detail by an injector head 14 at the top of kelly 16 for receiving drilling mud forced through pipe 15 by a pump located in the mud pump apparatus 21. The drilling mud is forced down into the well through the hollow pipe of the drill string 35 into the working region of bit 40 for cooling purposes and for removing debris cut out by bit 40 from the well bore. The used mud and its included debris are returned upward to the earth's surface 33 in bore 36, where conventional apparatus (not shown) separates the mud, rejuvenating it for further cycles of use.

The portion of the drill string 35 below the earth's surface 33 will generally contain many major sections of threaded-together pipe elements. Near the earth's surface and at the lower part of the drill string 35 there will appear sub-units or pipe-like segments of minor length similarly joined in the drill string and sometimes larger in diameter than the major and much longer elements of the drill string. As has been well established in the art, these sub-units are provided as protective containers for sensors and their ancillary circuits, and for power supplies, such as batteries or conventional mud driven turbines which drive electrical generators or other means to supply electrical energy to operate transmitter and sensor devices or the like.

As noted, the drill string 35 is to serve as an acoustic energy propagation path whereby data may be telemetered between bit 40 and surface monitoring apparatus. It is seen that drill string 35 has, by way of example, three sub-units adjacent bit 40. In ascending order above drill bit 40, the first of these is the acoustic isolator sub-unit 39 including a mechanical filter for isolating the communication system from the energetic and wide band noise generated by drill bit 40 during its actual operation. Such mechanical filters are well known in the prior art, as typified by apparatus disclosed in the patent to H. B. Matthews, U.S. Pat. No. 4,066,995 for "Acoustic Isolation for a Telemetry System on a Drill String," issued Jan. 3, 1978 and assigned to Sperry Corporation.

In the next-above sub-unit 38, there is installed in a conventional manner a sensor or sensors adapted to generate an electrical measure or measures of data relating to the operation of drill bit 40, such as fluid pressure or temperature or the like. The sensor output signals are used to modulate an acoustic transmitter located in the third of the series sub-units 37. It is recognized that pluralities of sensors may be served in this manner by employing multiplexing apparatus such as in the U.S. Pat. No. 3,988,896 to H. B. Matthews entitled "Geothermal Energy Pump and Monitor System," issued Nov. 2, 1976 and also assigned to Sperry Corporation. The vibrations of the acoustic transmitter within sub-unit 37 are coupled to drill string 35, thereby exciting a data-encoded acoustic wave which propagates toward the earth's surface 33 along drill string 35.

Near the top of drill string 35 is located a conventional receiver sub-unit 32 for a device for receiving the acoustic wave propagating within drill string 35. The receiver within sub-unit 32 is adapted to furnish the telemetric data via terminals 31 through the band pass electrical filter 50 of FIG. 1A to a display such as a conventional electrical meter 51 or to a suitable recorder 52. It will be appreciated by those skilled in the art that a synchronously multiplexed receiver and recorder system such as illustrated in the aforementioned in U.S. Pat. No. 3,988,896 may alternatively be employed.

Between receiver sub-unit 32 and the rotary table 20 there is disposed in drill string 35 a second noise isolation sub-unit 30 which may contain a mechanical filter generally similar to that of sub-unit 39. Its function is to attenuate vibrations within the pass band of the receiver due to the gear driven rotation of rotary turn table 17 and to the operation of various other apparatus on the drilling platform 22, including kelly 16. Acoustic noise within the pass band of the receiver that may arrive at the receiver input as a result of pulsations in the flowing mud generated by the mud pump of apparatus 21 may also be attenuated by placing a suitable damper (not shown) in pipe 15.

While the invention is particularly suited for use with well drilling equipment and is therefore illustrated herein in such an environment, it has application also in permanent down-well installations, such as in oil or water pumping equipment. In particular, it also has application in the telemetering of data to the earth's surface relative to the performance of a down-well pumping system for extracting energy from hot geothermal brine disposed in subterranean strata of the earth. For example, it finds use in the acoustic data transmitting channel of geothermal systems such as are taught in the aforementioned H. B. Matthews U.S. Pat. No. 3,988,896 and in the K. W. Robbins, G. F. Ross U.S. Pat. No. 4,107,987, issued Aug. 22, 1978 for "Geothermal Well Pump Performance Sensing System and Monitor Therefore," both patents being assigned to Sperry Corporation.

In the drilling instrumentation, for example, it is required efficiently to drive an acoustic transmitter that is mechanically coupled to the drill string itself, as at subsection 37 of FIG. 1. Operation of the electrically excitable transmitter generates acoustic waves that propagate upwards in the drill string to the surface-located receiver. Acoustic loss measurements made upon the types of pipes used in well drilling and in geothermal brine pumping systems clearly indicate that the sonic carrier must have a relatively low audio carrier frequency. The relative low frequencies are required since higher frequencies suffer serious attenuation per unit length of piping of the aforementioned kind and acoustic propagation becomes difficult even at moderate well depths.

Figure 2:
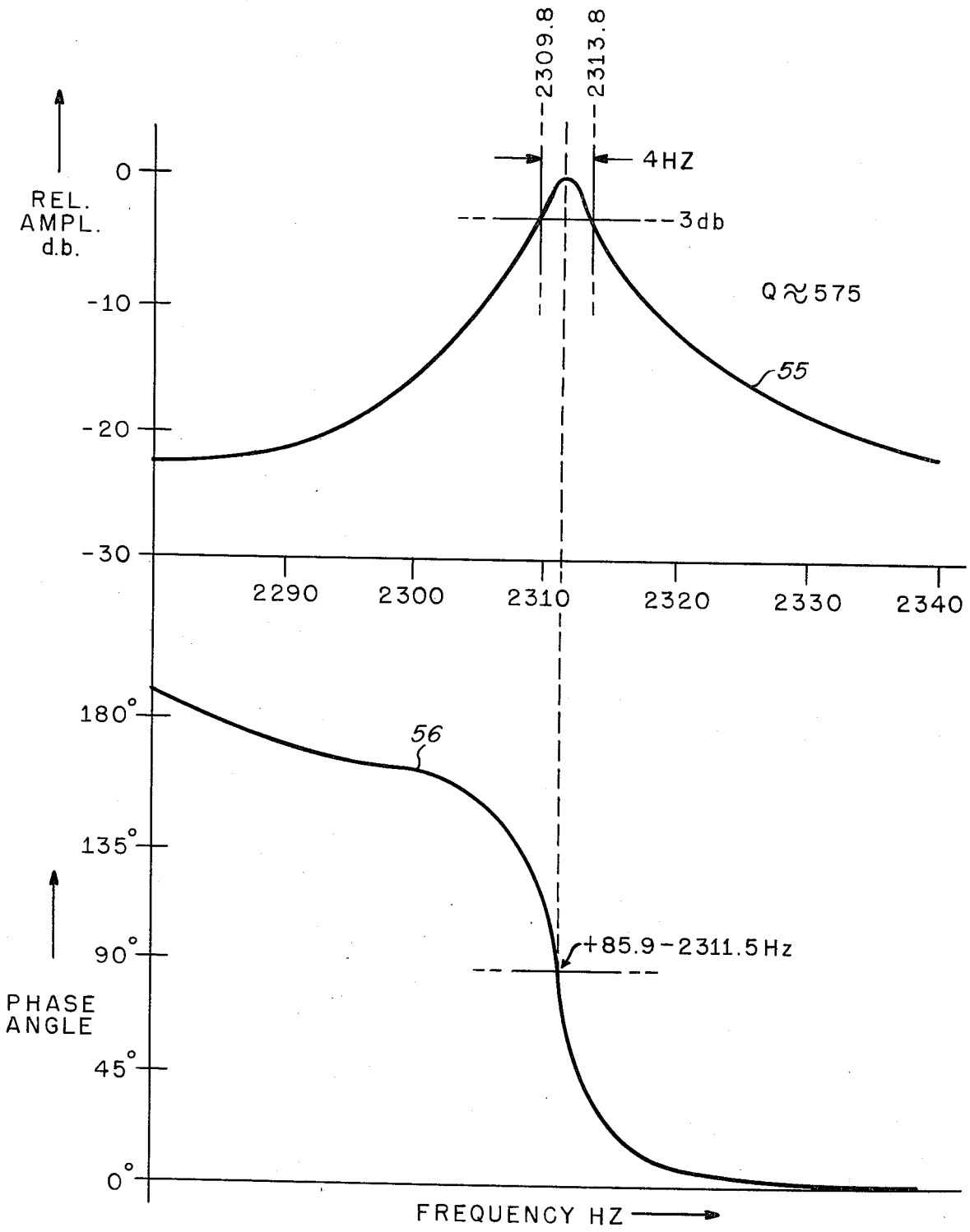
FIG. 2 is a graph useful in explaining the operation of the invention.

A further difficulty lies in the presence in the mechanical structure of the acoustic wave propagating piping of a plurality of sharp resonances whose locations and separations are often difficult to predetermine or to locate empirically in a complex mechanical structure. To achieve reliable and efficient coupling between the acoustic transmitter and the drill string, it is necessary to operate the acoustic transmitter at one of the drill string piping resonant frequencies. As an example, curve 55 of FIG. 2 shows the experimentally derived amplitude transmission characteristic of a length of drill string pipe between 2280 and 2340 Hz; it demonstrated a resonance peak about 2310 Hz. Curve 56 of FIG. 2 shows the corresponding phase characteristic of the pipe sample. It is observed that the pass band width is only about 4 Hz at the 3 dB points, and that there is a rapid phase shift at resonance.

Driving the acoustic transmitter in an open loop configuration as was done in the aforementioned Matthews and Robbins et al. patents is therefore not always attractive because it is difficult to tune the transmitter driver frequency, when the apparatus is remotely located at the bottom of the well, to the center of the aforementioned resonance. Even if properly tuned, temperature changes suffered by the apparatus near the working drill bit or brine pump will alter the carrier drive frequency and, in addition with alter the degree of mechanical coupling of the transducer to parts it is to excite. Further, mechanical dimensions of parts associated with the transmitter and propagation medium change so that the selected mechanical resonance itself also drifts. The present invention provides a feed back system which allows the carrier frequency to adjust slightly within a closed loop, but causing it always to be close to the peak of the transmission resonance curve despite the adverse effects of changes in temperature, acoustic coupling, and the like.

Figure 3:
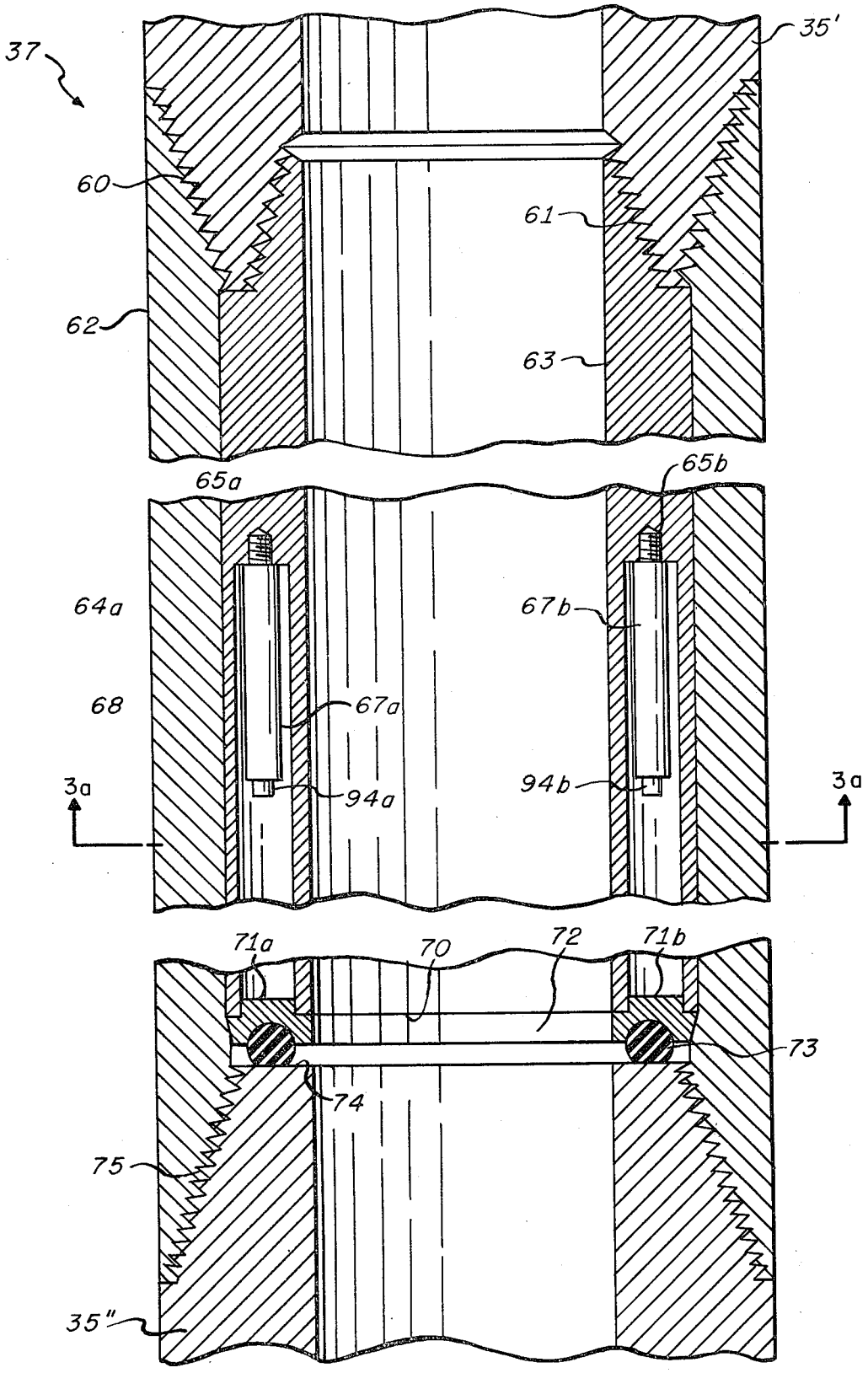
FIG. 3 is an elevation view in partial cross section of a portion of the drill string of FIG. 1.
Figure 3A:
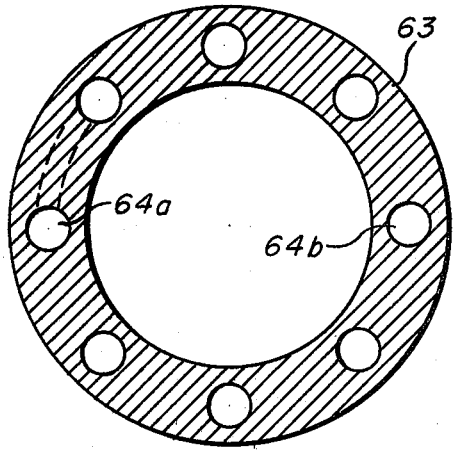
FIG. 3A is a plan view in cross section taken at the line 3A—3A of FIG. 3.

FIGS. 3 and 3A illustrate in more detail the actual locations of the acoustic transmitter invention within the wall of the acoustic transmitter sub-unit 37. The sub-unit housing 37 consists of two cooperating coaxial hollow cylinders 62, 63. The inner cylinder 63 is attached by threads 61 to the lower end of a unit 35' of the drill string 35 of FIG. 1 and ends at surface 70 at right angles to the axis of the drill string. The second hollow cylinder 62 has an inner wall 68 which may be in contiguous relation with the outer surface of the wall of cylinder 63. Furthermore, outer cylinder 62 is attached by threads 60 to the upper drill string part 35'.

As seen in FIGS. 3 and 3A, the hollow cylinder 63 is equipped with a plurality of bores, such as bores or cylindrical cavities **64*a*, 64*b*, which may be interconnected. By way of example, the two opposed bores or cavities 64*a*, 64*b* may be employed for containment of active co-phasally driven acoustic transducers, while other of the bores shown in FIG. 3A** may be used as locations for other down-well equipment and for conventional vibration driven power supplies or for batteries for activating the various electronic elements, including apparatus associated with the acoustic transducers.

Referring especially to FIG. 3, each of the two opposed cavities 64*a*, 64*b* contains an acoustic transmitter transducer according to the invention. For example, the transmitter device 67*a* within bore 64*a* includes a piezoelectric driver section and a resonating mass system, both supported in collineal relation by a threaded bolt 65*a* extending into a threaded bore at the upper internal end of bore 64*a*.

To keep components of the drilling mud flowing in the interior of hollow cylinder 63 from entering the bores such as bore 64*a*, a ring-shaped end piece 72 may be provided, fitting against the end 70 of cylinder 63. Ring 72 is equipped with spaced circular bosses such as bosses 71*a*, 71*b* which extend into bores or cavities 64*a*, 64*b*, et cetera, excluding such contaminants. Ring 72 may be permanently or semi-permanently affixed to surface 70, as desired. Other means for sealing the cavities 64*a*, et cetera, will be readily apparent to those skilled in the art.

The outer hollow cylinder 62 is equipped with threads 75 at its lower end disposed below the aforementioned parts. Its purpose is to enable coupling of the sub-unit 37 to the next lowest portion 35″ of the drill string 35. In addition, the drill string part 35″ is equipped with a flat upper surface 74 perpendicular to its axis. In this manner, when sub-unit 37 is affixed to drill string portion 35″, an O-ring 73 or the equivalent is compressed by surface 74 into an annular O-ring seat disposed in the lower annular face of ring 72. It is seen that the assembly permits successful successive coupling and uncoupling of sub-unit 37 between drill string portions 35′, 35″, the inner cylinder 63 containing and protecting the acoustic transmitter system and the outer cylinder 62 cooperating in the same function and also serving as the primary load-bearing connection between drill string portions 35′, 35″. It will be understood by those skilled in the art that the FIG. 3 transducer and its container 63 may be inverted so that bore 64*a* is pointed upward and so that the transducer 67*a* projects upward from a corresponding bolt 65*a*. It will further be understood that the dimensions and proportions in the various figures have been distorted in the interest of making the drawings clear and that the dimensions illustrated would not necessarily be used in practice. In one practical embodiment of the invention, by way of example, the transducer element was about one inch in diameter, its over-all length was about three feet, and the mass-spring resonator was about two feet long.

Figure 4:
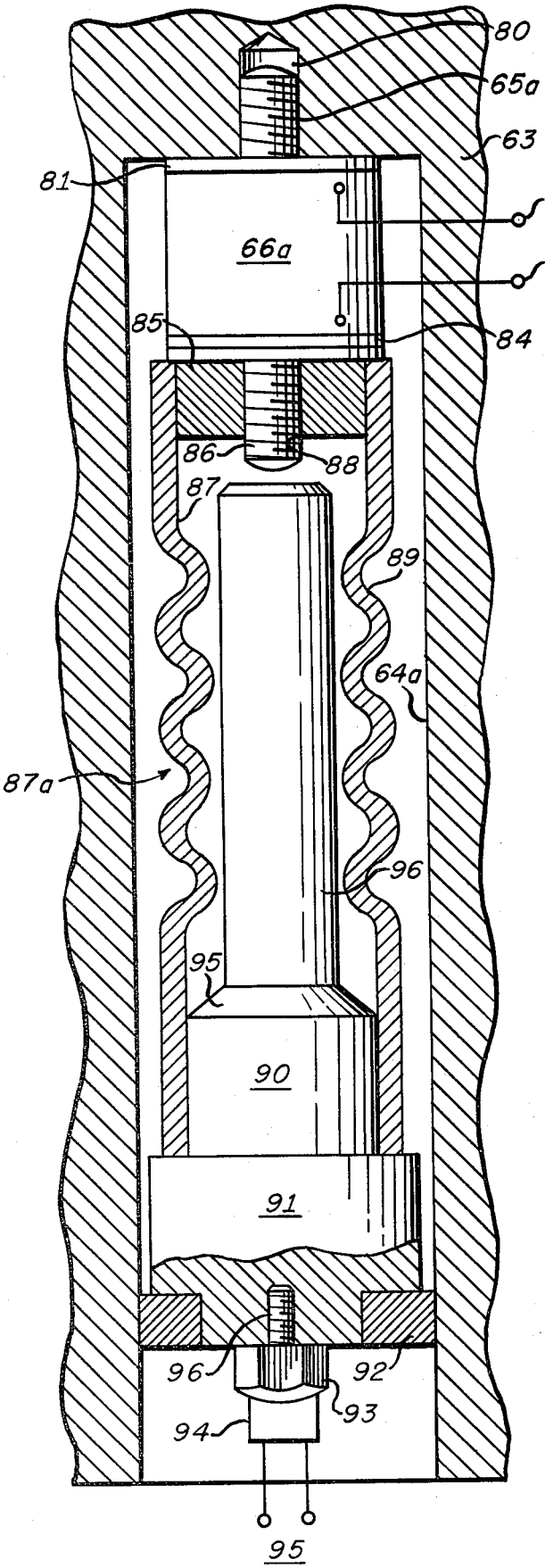
FIG. 4 is an enlarged view, partly in cross section, of the transducer element found in FIG. 3.

The sonic transmitter assemblies 67*a*, 67*b* of FIG. 3 each may take the form shown in more detail in FIG. 4; as in FIG. 3, each such transducer assembly is suspended by a headless bolt 65*a* threaded into a bore 80 within the top surface of a wall of hollow cylinder 63. Bolt 65*a* extends through a generally conventional sonic piezoelectric wave exciter 66*a* including, as will be further discussed, an assemblage of piezoelectric disks. The piezoelectric disks of element 66*a* are maintained in axial compression between apertured insulator end disks 81, 84. This is accomplished by the hollow cylindrical portion 85 of a cooperating steel member having an axial bore 88 extending therethrough. In practice, the hollow internally threaded part 85 is rotated on the threads of bolt 86 until the stack of ceramic high dielectric disks within piezoelectric element 66*a* experiences the desired level of compression. The threaded steel part 85 may then be fixed against further rotation with respect to the threads of bolt 86 by the application of a taper pin or other fastener in the usual manner. If desired, the upper end 65*a* of the headless bolt may be pinned in the same manner, but with respect to wall 63. Bolt 86 is made of a high-strength, low thermal expansion alloy such as a corrosion resistant alloy of nickel, iron, and chromium sold under the trademark Incoloy by the International Nickel Company. Accordingly, when bolt 86 is once properly stressed by rotation of the threaded steel part 85, compression of the piezoelectric stack 66*a* remains substantially constant.

The threaded steel part 85 forms a suspension for a novel spring-mass system to be vibrated axially by piezoelectric driver 66*a*. In particular, a hollow tube has an end section 87 whose inner diameter matches the outer diameter of part 85 and is welded or otherwise permanently affixed thereto. At a mid-section of the tube is a bellows-like corrugated section 89 which forms an active axial spring for the system. The spring 89 and its constant diameter ends 87, 98 are preferably formed of stainless steel tubing with the mid-section 89 swaged into a regular corrugated shape for providing the required longitudinal spring action along the spring axis. Characteristic of the spring section 89 is the fact that it desirably retains substantially the same lateral rigidity as is present in the original tube itself, and for the same reasons.

At the free end 98 of spring 87, 89, 98, the inner diameter of the spring section matches the outer diameter of a section 90 of the suspended mass 90, 91, 96 and is fastened permanently thereto, as by welding. A tapered portion 95 integral with sections 90 and 96 extends above section 91 and integrally supports the mass element 96 whose diameter is designed to clear the inner surface of spring 89. The free end portion 91 of mass 90, 91, 96 has an expanded diameter relative to portions 90, 96, just clearing the inner surface of the bore 64*a* in wall 63. Affixed in a ring-shaped depression in the mass part 91 is an annular hardened steel bearing 92. The lubricated bearing surface moves axially in relatively friction-free manner in contact with the steel surface 64*a* of circular bore 87*a*. The end portion 91 of the mass system is conveniently fitted with an integral hexagonal bolt head 93 to facilitate inserting and withdrawing the assembly from threaded bore 80. The integrated mass 90, 91, 92 may be constructed of steel, though other materials may be found suitable. Sintered or solid tungsten, because of its high density, is of spherical interest. An additional advantage of the novel configuration shown in FIG. 4 lies in the re-entrant disposal of the mass elements 90, 95, 96 into the interior of the hollow spring portion 89, making full use of available space and making it possible for the length of the transducers and of bores 64*a*, 64*b*, at cetera, to be shortened, thus decreasing the overall length of the sub-unit 37 and its cost. The outer end portion 91 of mass 91, 90, 96 is equipped with a conventional accelerometer 94 whose output leads appear at 95.

The generally conventional piezoelectric driver 66*a* is a sonic driver of the kind known to produce axial vibrations when an alternating voltage is coupled to leads 82, 83 of FIG. 4. In general, the disks making up the driver 66*a* are prepared and assembled followjng prior art practice such as is widely discussed in the literature. In one design of the driver 66*a*, a stack of about 200 ceramic apertured disks was employed, each with a $\frac{7}{8}$ inch outside diameter and with a centered $\frac{3}{8}$ inch hole. The disks were formed of PZT 5550 material readily available on the market. The opposed faces of each disk were optically lapped and supplied with sputtered chromium layers adhesive to the ceramic surface and then with conductive gold layer, readily adhesive to the chromium. When stacked, this conductive plates were interposed, alternate ones of these plates being coupled to one terminal of the a.c. driving power source, while the intervening plates were similarly coupled to the second terminal of that driving power source. In this manner, the total stack 66*a* of the ceramic elements is electrically in parallel when driven, but yields serial or axial cyclic longitudinal expansion and contraction.

Figure 5:
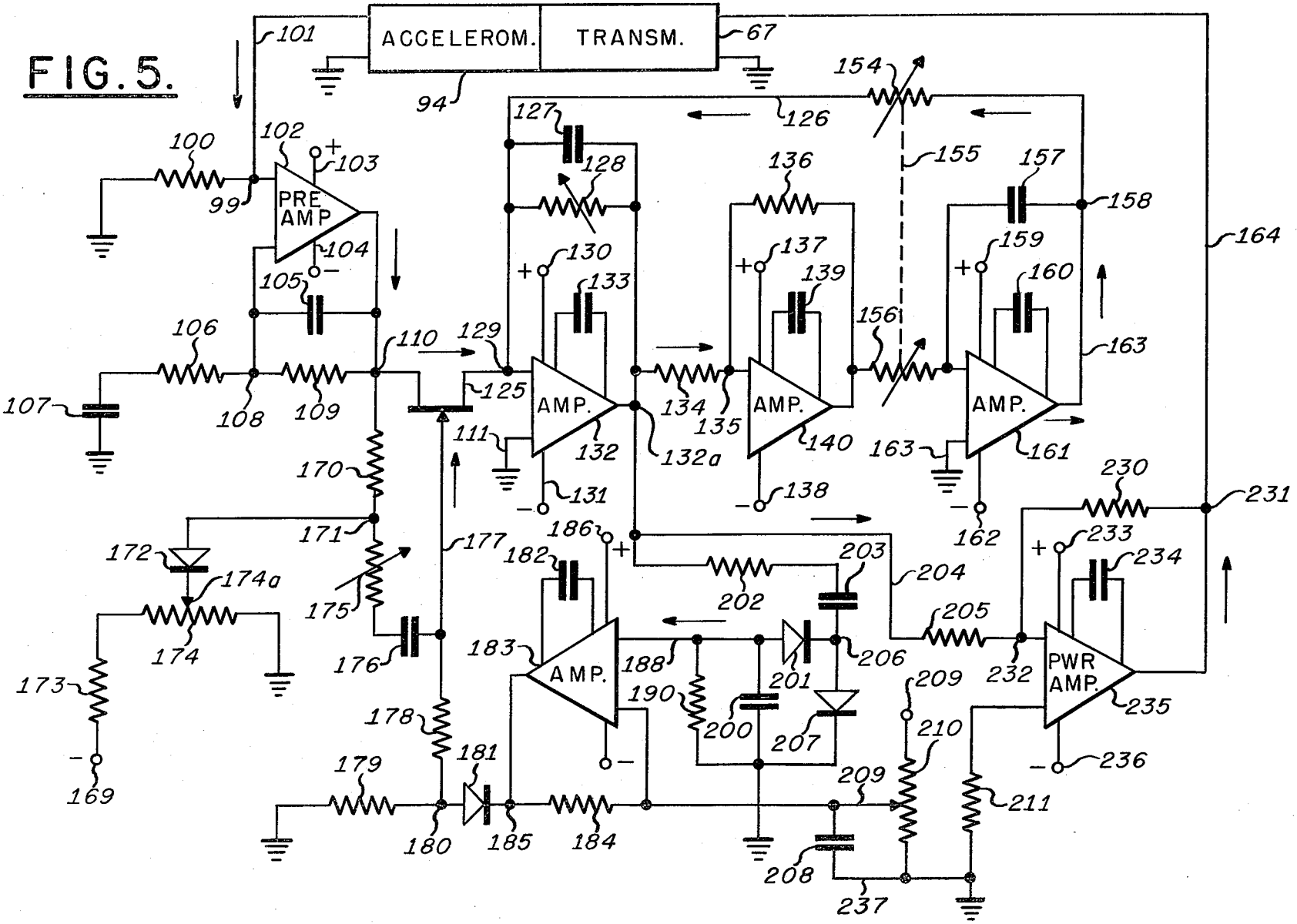
FIG. 5 is an electrical diagram of apparatus for operating the piezoelectric driver of FIG. 4, showing electrical components and their interconnections.

In the embodiment of the invention disclosed in FIG. 5, the accelerometer 94 of FIG. 4 is again shown mechanically affixed directly to the driving transmitter 67. The output of accelerometer 94 is coupled via lead 101 to junction 99 of an input biasing network including the grounded bias resistor 100 and then into a preamplifier 102 supplied in the usual manner via power input terminals 103, 104. The second cooperating terminal of preamplifier 102 is coupled in the feed back network at junction 108 wherein capacitor 107 and resistor 106 are series coupled to ground and through the parallel disposed capacitor 105 and resistor 109 coupled to junction 110. The circuit associated with preamplifier 102 serves as a high impedance buffer stage and provides gain control.

The preamplifier output is fed from junction 110 through the signal terminals of field effect transistor 125 to one input terminal of amplifier 132, the other input 111 of which is grounded. Amplifier 132 is supplied with the usual power input terminals 130, 131 and with a variable feed back net work including capacitors 127, 133 and variable resistor 128, and provides a useful output at terminal 132*a*. Amplifier 132, together with the series coupled preamplifiers 140 and 161 cooperate to limit the band width of the signal. Amplifier 140, whose input is provided through junction 132*a* and resistor 134, is provided with power at terminals 137, 138, has a feed back capacitor 139, a feed back resistor 136, and an output coupled through variable resistor 156 to an input of amplifier 161. Amplifer 161 has feed back capacitors 157 and 160, together with the usual power inputs 159 and 162. Its output on lead 163 and terminal 158 is fed back through variable resistor 154 and lead 126 to the input terminal 129 of the aforementioned amplifier 132. Variable resistors 154, 156 are gang coupled by linkage 155. Amplifier 132 is coupled as an integrator, amplifier 140 as an inverter, and amplifier 161 as a second integrator so that a differentiated form of the input at 129 appears on feed back lead 126. Control of network 127, 128 determines the gain-band width of the active filter assembly of amplifiers, while the adjustable resistors 154, 156 set the center frequency of the effective filter pass band. This pass band encompasses the mechanical resonance peaks of transmitter 67, together with the maximum anticipated drift from that center frequency.

The useful output of amplifier 132 at terminal 132*a* is coupled via lead 204 and resistor 205 to one input 232 of power amplifier 235 having the usual supply terminals 233, 236 and a feed back capacitor 239 and resistor 230. The second input to power amplifier 235 is coupled through resistor 211 to ground. The amplified power output at terminal 231 is coupled via lead 164 to operate transmitter 67.

Secondly, the useful output of amplifier 132 at terminal 132*a* is coupled through resistor 202 and blocking capacitor 203 to a terminal 206 which is the input to a rectifier circuit. The latter includes diodes 201, 207, poled as shown, with a cooperating filter including capacitor 200 and resistor 190. The output of the rectifier on lead 188 passes into one terminal of direct current amplifier 183 having a feed back capacitor 182 and biasing resistor 184. Amplifier 183 acts as an active gain-limiting element in an automatic gain control circuit and is supplied with power via terminals 186, 187. Its output at junction 185 is fed through blocking diode 181 to junction 180 for supply through resistor 179 to ground and through resistor 178 via lead 177 to the current control biasing gate electrode of field effect transistor 125. The second input of d.c. amplifier 183 is supplied with a bias signal by virtue of potentiometer 210, lead 237, capacitor 208, and a power source (now shown) coupled to terminal 209 of potentiometer 210.

Thus, the automatic gain control loop is completed; the system will oscillate at a frequency at which the loop gain is unity and phase shift is zero. If the loop gain is greater than unity, the amplitude of oscillation automatically increases until some element in the loop shows non-linear behavior. To avoid consequent generation of a non-linear wave form, the automatic gain control circuit adjusts the gain to produce a constant amplitude purely sinusoidal output.

The network found in FIG. 5 between junction 110 and the bias gate electrode of the gain controlling field effect transistor 125 acts as a distortion minimizing network, changing the bias on the field effect transistor gate electrode as the wave form goes below the zero level. It includes a voltage divider comprising resistor 170, variable resistor 175, and capacitor 176, the center tap 171 between resistors 170, 175 being coupled through a clipper diode 172 to the tap 174*a* of a potentiometer 174. A bias is supplied through tap 174*a* by coupling potentiometer 174 between ground and resistor 173, one terminal 169 of which is coupled to a negative voltage source (not shown).

Figure 6:
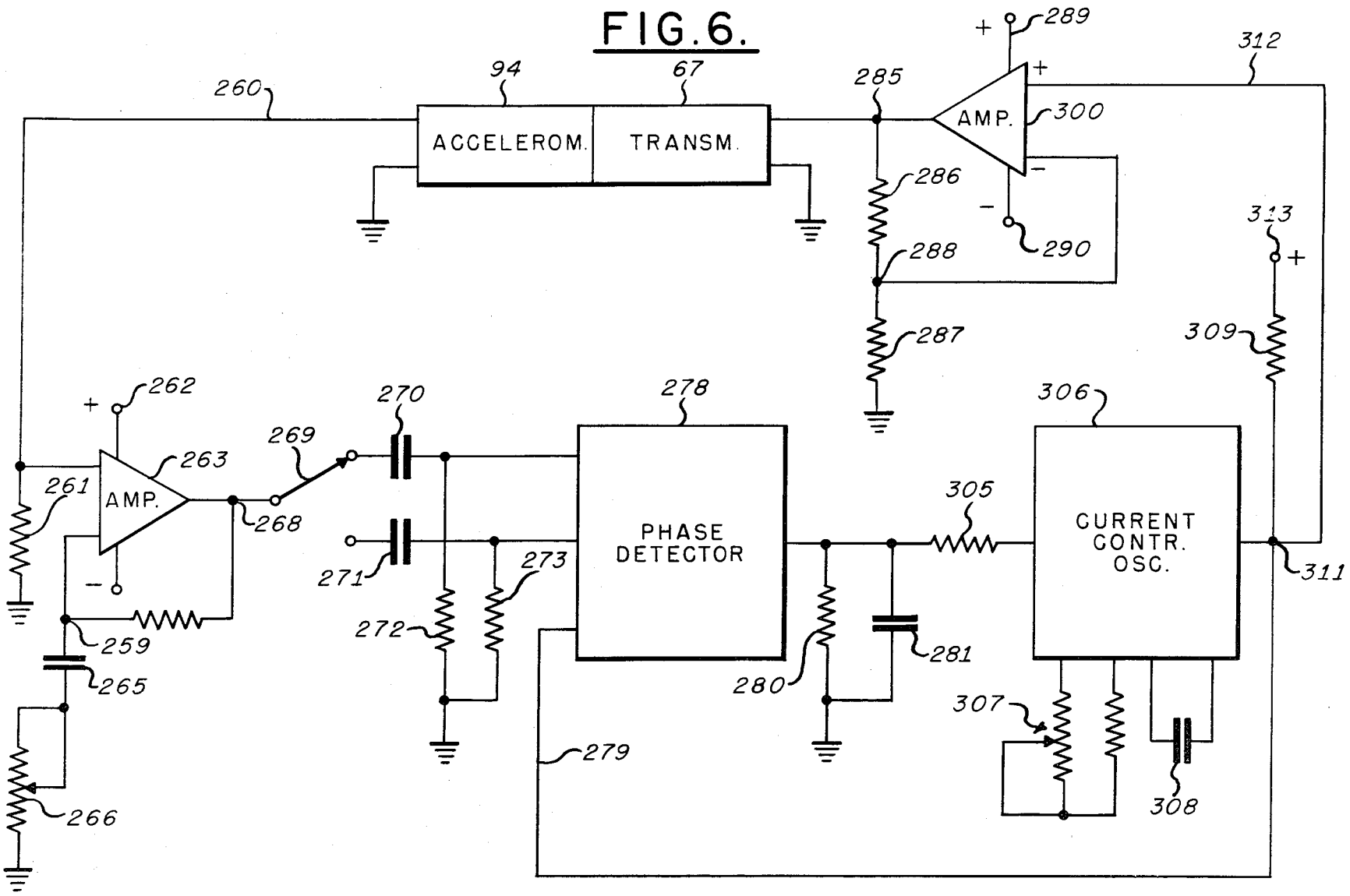
FIG. 6 is an electrical diagram of apparatus alternative to that of FIG. 5.

In the embodiment of the invention disclosed in FIG. 6, quick starting is enhanced and non-linearity of operation is avoided by the use of a phase-locked loop. The circuit runs freely in an open loop sense in starting, and then locks at its steady state operating frequency, the frequency that generates the correct phase shift through the mechanical portions of the system.

In FIG. 6, the accelerometer 94 is again shown mechanically affixed directly to the driving transmitter 67. The output of accelerometer 94 is coupled via lead 260 across input resistor 261 to one input of an amplifier 263 having the usual power supply inputs 262, 264. The second cooperating terminal of preamplifier 263 is coupled in a feed back network at junction 259 wherein capacitor 265 is coupled through the variable gain controlling resistor 266 to ground. To complete the feed back path, the output terminal 268 of amplifier 263 is coupled through resistor 267 to input junction 259.

The output of amplifier 263 may be corrected for phase compensation purposes before lowering the equipment into the well by the manual positioning of switch 269 so as to select an appropriate one of two inputs to the conventional phase detector 278. The signal at junction 268 may be injected into detector 278 through the R-C path 272–270 or through a second R-C path 271–273 having distinctive parameters. The input signal is compared in phase detector 278 to a fed back signal on lead 279.

The output of phase detector 278 is a bipolar direct current signal to control the frequency of a conventional current-controlled oscillator 306 which operates in locked-oscillator fashion to supply alternating power via terminal 311 to drive the transducer 67. The bipolar direct current is filtered by R-C network 280–281 and is applied via input resistor 305 to the control terminal of oscillator 306. The adjustable resistor network 307 is a conventional part of oscillator 310 and is provided for the purpose of setting the free running frequency within the locking range of the phase-locked loop. The adjustable resistor 307 operates in conjunction with capacitor 308 for this purpose.

In operation, the output terminal 311 of oscillator 310 is supplied with a positive potential through resistor 309 from a power supply (not shown) at terminal 313. Terminal 311 is coupled via lead 312 to one input of amplifier 300, supplied with power input terminals 289, 290. The output terminal 285 of power amplifier 300 is coupled to the input of transmitter 67. It is also connected to ground through resistors 286, 287 having a common junction 288, which terminal 288 is coupled back to the second input terminal of power amplifier 300.

It is seen that the mass-spring combination permits self-resonant operation of the piezoelectric transducer and is a novel and useful means for extending the mechanical resonance of the piezoelectric system to lower frequencies than is conventionally possible. The selected resonant frequency may be lower than previously, in the frequency range within which acoustic transmission losses in the drill string are favorably lowest.

While the invention has been described in its preferred embodiments, it is to be understood that the words which have been used are words of description rather than of limitation and that changes may be made within the purview of the appended claims without departing from the true scope and spirit of the invention in its broader aspects.

What is claimed is:

1. A system for the acoustic propagation of a data bearing carrier signal along a bore-hole drilling string including coupled hollow pipe sections, at least one of said hollow pipe sections having a first axis and a closed cavity in the wall thereof, said closed cavity having a second axis parallel to and offset from said first axis, said system comprising:

a piezoelectric transmitter adapted for compression and elongation along said second axis when subjected to an electric field parallel to said second axis, said piezoelectric transmitter being affixed to a surface of said closed cavity, a cylindrical spring affixed to said piezoelectric transmitter opposite said surface, an elongate mass having an axis collinear with said second axis and affixed to said cylindrical spring opposite said piezoelectric transmitter, an accelerometer fixedly coupled to said elongate mass, and an amplifier responsive to said accelerometer for driving said piezoelectric transmitter.

2. Apparatus as described in claim 1 wherein said amplifier includes:

a preamplifier responsive to said accelerometer, a band width limiting amplifier responsive to said preamplifier, a feed back circuit for coupling the output of said band width limiting amplifier to an input thereof, and a power amplifier responsive to said band width limiting amplifier for driving said piezoelectric transmitter.

3. Apparatus as described in claim 2 further including gain control means responsive to said band width limiting amplifier and disposed between said preamplifier and said band width limiting amplifier.

4. Apparatus as described in claim 3 wherein said band width limiting amplifier includes in series relation:

a first integrating amplifier, an inverting amplifier, and a second integrating amplifier.

5. Apparatus as described in claim 4 wherein said gain control means includes:

a rectifier responsive to said first integrating amplifier, a fourth amplifier responsive to said rectifier, and a field effect transmitter disposed between said preamplifier and said first integrator and responsive to said fourth amplifier.

6. Apparatus as described in claim 1 wherein said amplifier includes:

a preamplifier responsive to said accelerometer, a phase detector having first and second inputs, said first input being responsive to said preamplifier, and a current controlled oscillator responsive to said phase detector, said phase detector being additionally responsive to said current controlled oscillator, and said piezoelectric transmitter being responsive to said current controlled oscillator.

7. Apparatus as described in claim 6 further including means interposed in series between said preamplifier and said phase detector for selectively adjusting the phase of the output of said preamplifier.

8. Apparatus as described in claim 7 further including a filter interposed between said phase detector and said current controlled oscillator.

* * * * *